US009339429B1

(12) United States Patent
Eland-Rodriguez

(10) Patent No.: US 9,339,429 B1
(45) Date of Patent: May 17, 2016

(54) BODY TRANSFER ASSEMBLY

(71) Applicant: Lynne Eland-Rodriguez, Richmond, TX (US)

(72) Inventor: Lynne Eland-Rodriguez, Richmond, TX (US)

( * ) Notice: Subject to any disclaimer, the term of this patent is extended or adjusted under 35 U.S.C. 154(b) by 434 days.

(21) Appl. No.: 14/034,761

(22) Filed: Sep. 24, 2013

(51) Int. Cl.
*A61G 5/00* (2006.01)
*A61G 7/053* (2006.01)
*A61G 7/10* (2006.01)

(52) U.S. Cl.
CPC ..... *A61G 7/10* (2013.01); *A61G 7/1013* (2013.01); *A61G 7/1019* (2013.01); *A61G 7/1046* (2013.01)

(58) Field of Classification Search
CPC ..... A61G 7/00; A61G 7/012; A61G 7/018; A61G 7/10; A61G 7/1013; A61G 7/1019; A61G 7/104; A61G 7/1046
See application file for complete search history.

(56) References Cited

U.S. PATENT DOCUMENTS 5,438,721 A 8/1995 Pahno
6,085,372 A 7/2000 James et al.
D434,198 S 11/2000 Greaves
6,321,398 B1 * 11/2001 Wang ..... A61G 7/001 5/81.1 R
6,668,396 B2 12/2003 Wei
7,434,278 B2 10/2008 White et al.
8,280,748 B2 10/2012 Allen et al.
8,464,371 B1 * 6/2013 Martin ..... A61G 7/1019 5/175
2003/0226206 A1 12/2003 Ben-Levi
2010/0154117 A1 6/2010 Odashima et al.
2010/0229299 A1 * 9/2010 Lear ..... A61G 7/1015 5/89.1
2011/0000016 A1 * 1/2011 Shriver ..... A61G 7/1019 5/86.1
2011/0271443 A1 * 11/2011 Serhan ..... A61G 7/012 5/11
2012/0023660 A1 2/2012 Ota et al.
2012/0054964 A1 * 3/2012 Stroh ..... A61G 7/05776 5/613
2013/0312182 A1 * 11/2013 Jackson ..... A61G 7/001 5/607
2013/0318708 A1 * 12/2013 Wang ..... A61G 7/1003 5/87.1
2014/0047641 A1 * 2/2014 Thodupunuri ..... A61G 7/002 5/613
2014/0317843 A1 * 10/2014 Martin ..... A61G 7/10 5/87.1

* cited by examiner

*Primary Examiner* — David E Sosnowski

(57) ABSTRACT

A body transfer assembly for moving a user on a bed includes a stand that may be positioned on a support surface. A housing is coupled to the stand. A motor is coupled to the housing. A processor is coupled to the housing. The processor is operationally coupled to the motor. A timer is coupled to the housing. The timer is operationally coupled to the processor so the timer controls a speed of the motor. An actuator is coupled to the housing. The actuator is operationally coupled to the processor. An arm is movably coupled to the housing. The arm is operationally coupled to the motor so the motor alternatively raises and lowers the arm. A rod is coupled to the arm. A bed is coupled to the rod so the bed may support the user. A mattress is positioned on the bed so the user lies on the mattress.

16 Claims, 4 Drawing Sheets

BODY TRANSFER ASSEMBLY

BACKGROUND OF THE DISCLOSURE

Field of the Disclosure

The disclosure relates to body transfer devices and more particularly pertains to a new body transfer device for moving a user on a bed.

SUMMARY OF THE DISCLOSURE

An embodiment of the disclosure meets the needs presented above by generally comprising a stand that may be positioned on a support surface. A housing is coupled to the stand so the stand supports the housing above the support surface. A motor is coupled to the housing. A processor is coupled to the housing. The processor is operationally coupled to the motor. A timer is coupled to the housing. The timer is operationally coupled to the processor so the timer controls a speed of the motor. An actuator is coupled to the housing. The actuator is operationally coupled to the processor. An arm is movably coupled to the housing. The arm is operationally coupled to the motor so the motor alternatively raises and lowers the arm. A rod is coupled to the arm. The rod moves in tandem with the arm. A bed is coupled to the rod so the bed may support the user. A mattress is positioned on the bed so the user lies on the mattress.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
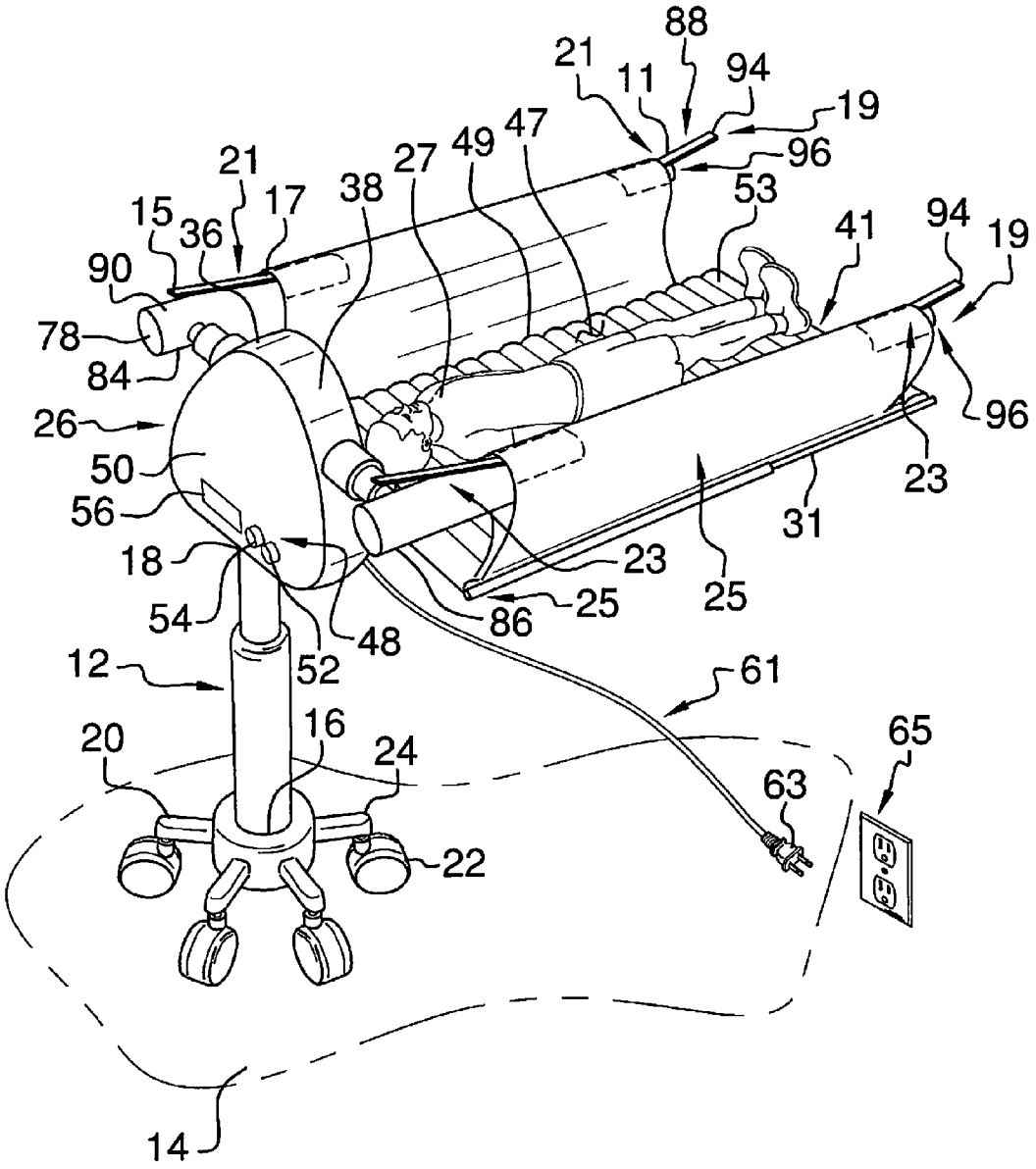
FIG. 1 is a perspective view of a body transfer assembly according to an embodiment of the disclosure.
Figure 2:
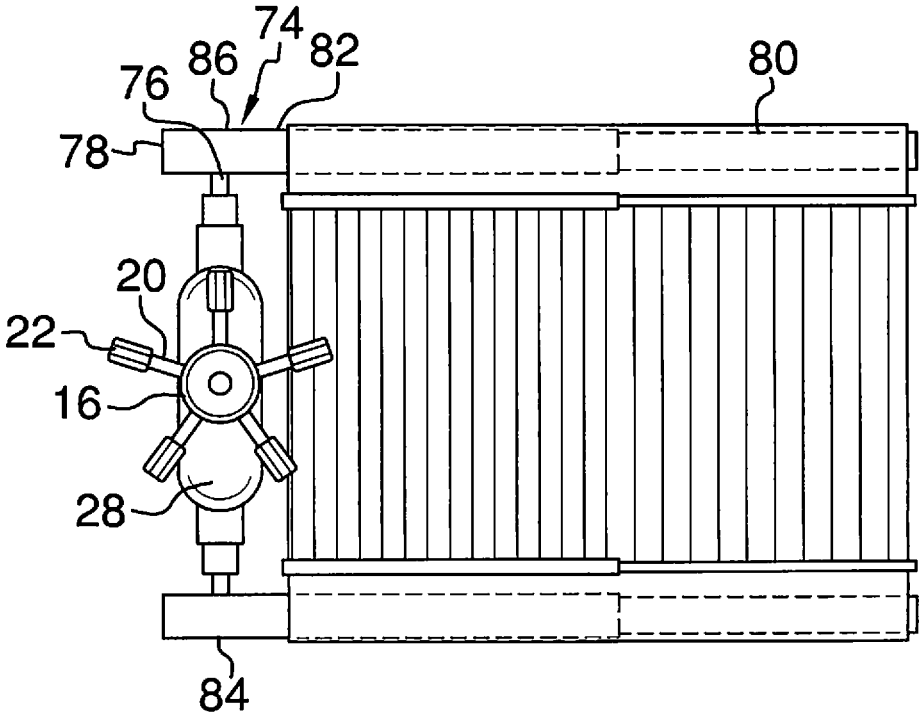
FIG. 2 is a top view of an embodiment of the disclosure.
Figure 3:
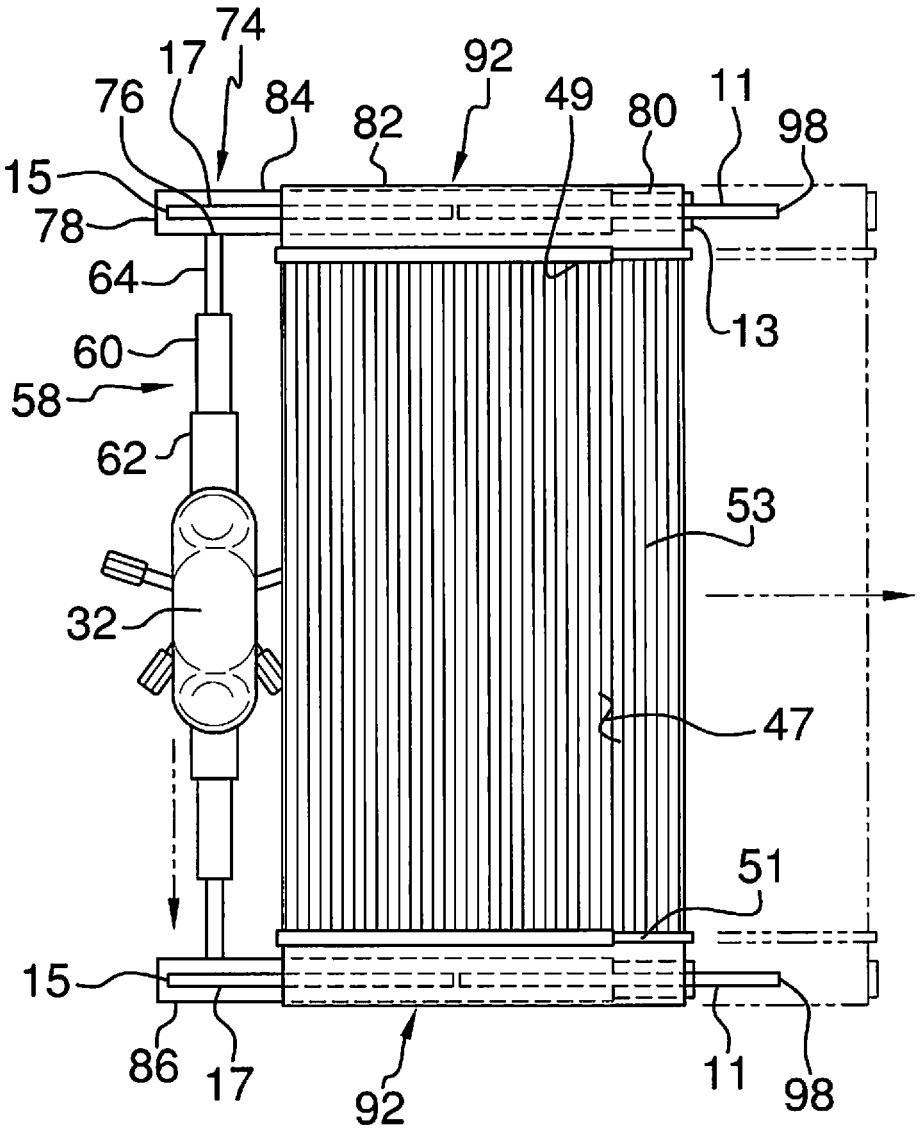
FIG. 3 is a bottom view of an embodiment of the disclosure.
Figure 4:
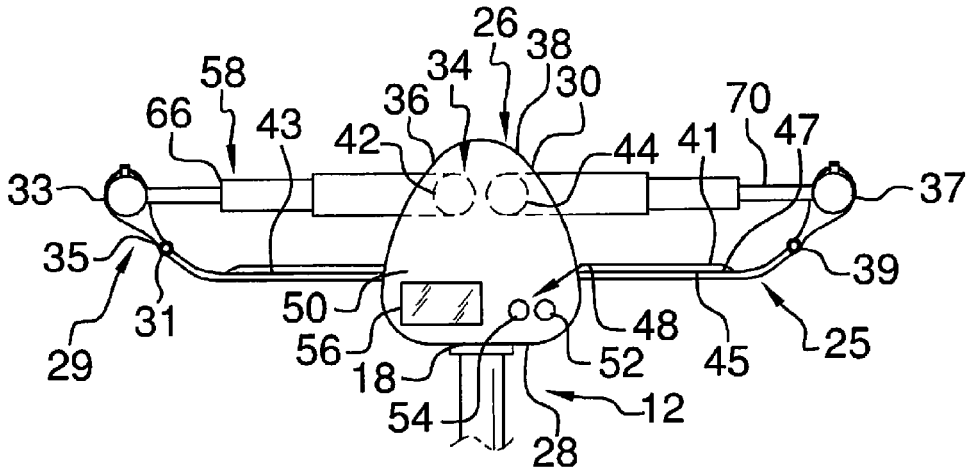
FIG. 4 is a back view of an embodiment of the disclosure.
Figure 5:
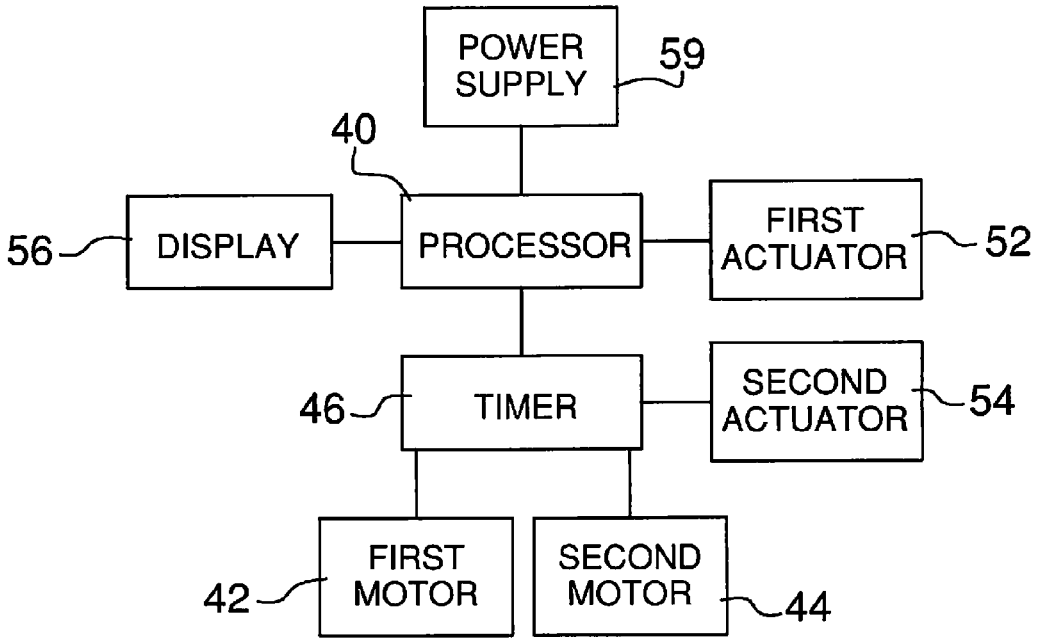
FIG. 5 is a schematic view of an embodiment of the disclosure.

With reference now to the drawings, and in particular to FIGS. 1 through 5 thereof, a new body transfer device embodying the principles and concepts of an embodiment of the disclosure and generally designated by the reference numeral 10 will be described.

As best illustrated in FIGS. 1 through 5, the body transfer assembly 10 generally comprises a stand 12 that may be positioned on a support surface 14. The stand 12 is elongated along a longitudinal axis extending between a bottom end 16 and a top end 18 of the stand 12. Moreover, the stand 12 has a telescopically adjustable height. Lastly, the stand 12 may be adjusted to a height between 90 cm and 152 cm.

A leg 20 is coupled to and extends laterally away from the stand 12 proximate the bottom end 16 of the stand 12. Additionally, a wheel 22 is coupled to a free end 24 of the leg 20. The wheel 22 abuts the support surface 14 so the stand 12 is movable along the support surface 14. Further, the leg 20 is one of a plurality of the legs 20 that are evenly distributed around an entire circumference of the stand 12. Lastly, the wheel 22 is one of a plurality of wheels 22 each coupled to the free end 24 of an associated one of the plurality of legs 20.

A housing 26 is provided. A bottom side 28 of an outer wall 30 of the housing 26 is coupled to the top end 18 of the stand 12. Continuing, the housing 26 extends upwardly from the top end 18 of the stand 12 so the stand 12 supports the housing 26 above the support surface 14. A top side 32 of the outer wall 30 of the housing 12 has a width that is less than a width of the bottom side 28 of the outer wall 30 of the housing 26. Moreover, the housing 26 has a tear drop shape.

A motor is 34 coupled to the housing 26. The motor 34 is positioned within an interior of the housing 26. Continuing, the motor 34 is one of a pair of motors 34 each positioned proximate an associated one of a first lateral side 36 and a second lateral side 38 of the outer wall 30 of the housing 26. The motor 34 may be an electrical motor of any conventional design.

A processor 40 is coupled to the housing 26. Moreover, the processor 40 may be an electronic processor of any conventional design. The processor 40 is operationally coupled to each of a first one 42 and a second one 44 of the pair of motors. Additionally, a timer 46 is coupled to the housing 26. The timer 46 is electrically coupled to the processor 40 so the timer 46 controls a speed of the first 42 and second 44 motors. Continuing, the timer 46 determines a delay between the first 42 and second 44 motors rotating in a upward direction and a downward direction. The first 42 and second 44 motors are actuated in the upward and downward directions oppositely from each other.

An actuator 48 is coupled to a back side 50 of the outer wall 30 of the housing 26 proximate the bottom side 28 of the outer wall 30 of the housing 26. The actuator 48 is one of a pair of actuators 48. Continuing, a first one of the pair of actuators 52 is electrically coupled to the processor 40. The first actuator 52 selectively actuates and de-actuates the first 42 and the second 44 motors. Moreover, a second one of the pair of actuators 54 is electrically coupled to the timer 46. The second actuator 54 selects a pre-determined duration of time stored in the timer 46. Lastly, the pre-determined duration of time may be a duration between 35 minutes and 45 minutes.

A display 56 is coupled to the back side 50 of the outer wall 30 of the housing 26 proximate the bottom side 28 of the outer wall 30 of the housing 26. Continuing, the display 56 is electrically coupled to the processor 40. The display 56 displays indicia. Moreover, the indicia comprise information pertaining to operational parameters of the timer, the first motor 42 and the second motor 44. Lastly, the display 56 may be an LCD display of any conventional design.

An arm 58 is movably coupled to and extends laterally away from the outer wall 30 of the housing 26. A second portion 60 of the arm 58 is slidably coupled to and extends laterally away from a first portion 62 of the arm 58. Moreover, a third portion 64 of the arm 58 is slidably coupled to and extends laterally away from a second portion 60 of the arm 58. The arm 58 has a telescopically adjustable length. Further, the arm 58 may adjusted to a length between 30 cm and 90 cm.

The arm 58 is one of a pair of arms 58. A first one of the pair of arms 66 is positioned on the first lateral side 36 of the outer wall 30 of the housing 26. The first arm 66 is operationally coupled to the first motor 42 so the first motor 42 alternatively raises and lowers the first arm 66. Continuing, a second one of the pair of arms 70 is positioned on the second lateral side 38 of the outer wall 30 of the housing 26. The second arm 70 is operationally coupled to the second motor 44 so the second motor 44 alternatively raises and lowers the second arm 70. Lastly, each of the first 66 and second 70 arms is centrally positioned on the associated one of the first 36 and second 38 lateral sides of the outer wall 30 of the housing 26.

A rod 74 is coupled to a first end 76 of the third portion 64 of the arm 58 proximate a second end 78 of the rod 74. Continuing, the rod 74 extends forwardly away from the arm 58 such that the rod 74 forms a right angle with respect to the arm 58. The rod 74 moves in tandem with the arm 58 when the arm 58 is moved upwardly and downwardly by the motor 34. A second portion 80 of the rod 74 is slidably coupled to a first portion 82 of the rod 74. Moreover, the rod 74 has a telescopically adjustable length. The rod 74 may be adjusted to a length between 90 cm and 190 cm.

The rod 74 is one of a pair of rods 74. A first one of the rods 84 is coupled to the first arm 66. A second one of the rods 86 is coupled to the second arm 70. Continuing, the first 84 and second 86 rods alternatively move closer to the support surface 14 when the associated one of the first 42 and second 44 motors rotates in the downward direction. The first 84 and second 86 rods alternatively move further away from the support surface 14 when the associated one of the first 42 and second 44 motors rotates in the upward direction.

A tongue 88 is movably coupled to a top side 90 of the rod 74 proximate a center 92 of the rod 74. The tongue 88 is coextensive with the rod 74 so a free end 94 of the tongue 88 is elevated above the rod 74 proximate an end 96 of the rod 74. Moreover, the tongue 88 forms an acute inside angle with respect to the rod 74. Lastly, the tongue 88 may have a length between 45 cm and 60 cm.

The tongue 88 is one of a pair of tongues 88. A second end 98 of a first one of the pair of tongues 11 is directed toward a first end 13 of the second portion 80 of the rod 74. Continuing, a second end 15 of a second one of the pair of tongues 17 is directed toward the second end 78 of the first portion 82 of the rod 74. The pair of tongues 88 is one of a pair of sets of the pair of tongues 19. A first set of the pair of tongues 21 is positioned on the first rod 84. Additionally, a second set of the pair of tongues 23 is positioned on the second rod 86. The second ends 98 of each of the first 21 and second 23 sets of tongues are biased upwardly from the top side 90 of the associated first 84 and second 86 rods.

A bed 25 is coupled between the first 84 and second 86 rods. The bed 25 extends between the first 84 and second 86 rods so the bed 25 may support a user 27. The user 27 may be a patient in a hospital setting. Continuing, a loop 29 is coextensively coupled to an outer edge 31 of the bed 25. Lastly the loop 29 may have a diameter between 7 cm and 10 cm.

The loop 29 is one of a pair of loops 29. A first one of the pair of loops 33 is coupled to a first lateral side 35 of the outer edge 31 of the bed 25. Moreover, the first loop 33 insertably receives the first rod 84. A second one of the pair of loops 37 is coupled to a second lateral side 39 of the outer edge 31 of the bed 25. Moreover, the second loop 37 insertably receives the second rod 86 so the bed 25 is retained on the first 84 and second 86 rods. The bed 25 moves in tandem with the first 84 and second 86 rods. Additionally, each of the first 35 and second 39 lateral sides of the outer edge 31 of the bed 25 alternatively moves closer to and further away from the support surface 14.

A mattress 41 is positioned on a top surface 43 of the bed 25. A bottom surface 45 of the mattress 41 is coextensive with the top surface 43 of the bed 25. The user 27 lies on a top surface 47 of the mattress 41 so the user 27 is alternatively rolled between a first lateral side 49 and a second lateral side 51 of the mattress 41. Additionally, the assembly 10 rolls the user 27 along the mattress 41 to prevent bed sores and other ailment relating to surgical recovery. Moreover, the mattress 41 may be a far infrared mattress of any conventional design. The top surface 47 of the mattress 41 comprises a plurality of undulating curves 53 extending between the first 49 and second 51 lateral sides of the mattress 41. The plurality of undulating curves 53 are evenly distributed between a front end 55 and a rear end 57 of the mattress 41.

A power supply 59 is coupled to the housing 26. The power supply 59 is electrically coupled to the processor 40. Continuing, a power cord 61 is electrically coupled to the power supply 59. A free end 63 of the power cord 61 extends away from the outer wall 30 of the housing 26. Moreover, the free end 63 of the power cord 61 may be selectively electrically coupled to a power source 65. The power source 65 may be an electrical outlet 67 of any conventional design.

In use, the user 27 is positioned on the mattress 41. The second actuator 54 is actuated to select the pre-determined duration of time between 35 minutes and 45 minutes. Continuing, the first 42 and second 44 motors alternatively rotate in the upward and downward directions so the user 27 is rolled laterally along the mattress 41. The first 42 and second 44 motors return to a neutral position so the mattress 41 is parallel with the support surface 14. Moreover, the first 42 and second 44 motors continue to alternatively rotate in the upward and downward directions once during the selected duration of time. The assembly 10 allows for a comfortable repositioning of the user 27 while the user 27 recovers from surgery or is otherwise bedridden so the user 27 does not develop bedsores.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A body transfer assembly for moving a user on a bed, said assembly comprising:

a stand configured to be positioned on a support surface;

a housing coupled to said stand wherein said stand supports said housing above the support surface;

a motor coupled to said housing, said motor being a first motor of a pair of first and second motors;

a processor coupled to said housing, said processor being operationally coupled to said motor;

a timer coupled to said housing, said timer being operationally coupled to said processor wherein said timer controls a speed of said motor;

an actuator coupled to said housing, said actuator being operationally coupled to said processor;

an arm movably coupled to said housing, said arm being operationally coupled to said motor wherein said motor alternatively raises and lowers said arm;

a rod coupled to said arm wherein said rod moves in tandem with said arm;

a bed coupled to said rod wherein said bed is configured to support the user; and a mattress positioned on said bed;

said arm being movably coupled to and extending laterally away from an outer wall of said housing;

said arm comprising a second portion of said arm slidably coupled to and extending laterally away from a first portion of said arm;

said arm comprising a third portion of said arm slidably coupled to and extending laterally away from the second portion of said arm wherein said arm has a telescopically adjustable length;

said arm being one of a pair of arms;

a first one of said pair of arms being positioned on a first lateral side of an outer wall of said housing wherein said first arm is operationally coupled to the first motor; and a second one of said pair of arms being positioned on a second lateral side of an outer wall of said housing wherein said second arm is operationally coupled to the second motor.

2. The assembly according to claim 1 further comprising said stand being elongated along a longitudinal axis extending between a bottom end and a top end of said stand wherein said stand has a telescopically adjustable height.

3. The assembly according to claim 1 further comprising a bottom side of an outer wall of said housing being coupled to a top end of said stand wherein said housing extends upwardly from said top end of said stand.

4. The assembly according to claim 1 further comprising:

said first motor being positioned within an interior of said housing; and said motors each being positioned proximate an associated one of a first lateral side and a second lateral side of an outer wall of said housing.

5. The assembly according to claim 1 further comprising:

said rod being coupled to a first end of a third portion of said arm proximate a second end of said rod wherein said rod extends forwardly away from said arm such that said rod forms a right angle with respect to said arm; and a second portion of said rod being slidably coupled to a first portion of said rod wherein said rod has a telescopically adjustable length.

6. The assembly according to claim 1 further comprising:

said rod being one of a pair of rods;

said arm being one of a pair of arms;

a first one of said rods being coupled to a first one of said arms; and a second one of said rods being coupled to a second one of said arms.

7. The assembly according to claim 1 further comprising:

a pair of tongues being one of a pair of sets of said pairs of tongues;

a first set of said pair of tongues being positioned on a first rod; and a second set of said pair of tongues being positioned on a second rod.

8. The assembly according to claim 1 further comprising said rod being one of a pair of rods and said bed being coupled between the rods wherein said bed extends between said pair of rods.

9. The assembly according to claim 1 further comprising:

said rod being one of a pair of rods;

a loop coextensively coupled to an outer edge of said bed;

said loop being one of a pair of loops;

a first one of said pair of loops being coupled to a first lateral side of said outer edge of said bed wherein said first loop insertably receives a first rod of the pair of rods; and a second one of said pair of loops being coupled to a second lateral side of said outer edge of said bed wherein said second loop insertably receives a second rod of the pair of rods wherein said bed is retained on said first and second rods.

10. The assembly according to claim 1 further comprising:

said mattress being positioned on a top surface of said bed wherein a bottom surface of said mattress is coextensive with said top surface of said bed; and a top surface of said mattress comprising a plurality of undulating curves extending between a first lateral side and a second lateral side of said mattress wherein said plurality of undulating curves are evenly distributed between a front end and a rear end of said mattress.

11. The assembly according to claim 1 further comprising:

said actuator being coupled to a back side of an outer wall of said housing proximate a bottom side of said outer wall of said housing;

said actuator being one of a pair of said actuators;

a first one of said actuators being electrically coupled to said processor wherein said first one of said actuators selectively actuates and de-actuates said motor; and a second one of said actuators being electrically coupled to said timer wherein said second one of said actuators selects a pre-determined duration of time for said timer.

12. The assembly according to claim 1 further comprising said timer being electrically coupled to said processor.

13. The assembly according to claim 1 further comprising:

a display coupled to a back side of an outer wall of said housing proximate a bottom side of said outer wall of said housing;

said display being electrically coupled to said processor;

said display displaying indicia; and said indicia comprising information pertaining to operational parameters of said timer, the first motor and the second motor.

14. The assembly according to claim 1 further comprising:

a power supply coupled to said housing;

said power supply being electrically coupled to said processor; and a power cord electrically coupled to said power supply wherein a free end of said power cord extends away from an outer wall of said housing.

15. A body transfer assembly for moving a user on a bed, said assembly comprising:

a stand configured to be positioned on a support surface;

a housing coupled to said stand wherein said stand supports said housing above the support surface;

a motor coupled to said housing, said motor being a first motor of a pair of first and second motors;

a processor coupled to said housing, said processor being operationally coupled to said motor;

a timer coupled to said housing, said timer being operationally coupled to said processor wherein said timer controls a speed of said motor;

an actuator coupled to said housing, said actuator being operationally coupled to said processor;

an arm movably coupled to said housing, said arm being operationally coupled to said motor wherein said motor alternatively raises and lowers said arm;

a rod coupled to said arm wherein said rod moves in tandem with said arm;

a bed coupled to said rod wherein said bed is configured to support the user; and a mattress positioned on said bed;

a tongue movably coupled to a top side of said rod proximate a center of said rod;

said tongue being coextensive with said rod wherein a second end of said tongue is elevated above said rod proximate an end of said rod such that said tongue forms an acute inside angle with respect to said rod;

said tongue being one of a pair of tongues;

a second end of a first one of said pair of tongues being directed toward a first end of a second portion of said rod; and a second end of a second one of said pair of tongues being directed toward a second end of a first portion of said rod.

16. A body transfer assembly for moving a user on a bed, said assembly comprising:

a stand configured to be positioned on a support surface, said stand being elongated along a longitudinal axis extending between a bottom end and a top end of said stand wherein said stand has a telescopically adjustable height;

a housing comprising a bottom side of an outer wall of said housing being coupled to a top end of said stand wherein said housing extends upwardly from said top end of said stand wherein said stand supports said housing above the support surface;

a motor coupled to said housing, said motor being positioned within an interior of said housing, said motor being one of a pair of motors each positioned proximate an associated one of a first lateral side and a second lateral side of said outer wall of said housing;

a processor coupled to said housing, said processor being operationally coupled to at least one of said motors;

a timer coupled to said housing, said timer being electrically coupled to said processor wherein said timer controls a speed of at least one of said motors;

an actuator coupled to a back side of said outer wall of said housing proximate said bottom side of said outer wall of said housing, said actuator being one of a pair of actuators;

a first one of said actuators being electrically coupled to said processor wherein said first one of said actuators selectively actuates and de-actuates said pair of motors;

a second one of said actuators being electrically coupled to said timer wherein said second one of said actuators selects a pre-determined duration of time for said timer;

a display coupled to said back side of said outer wall of said housing proximate said bottom side of said outer wall of said housing, said display being electrically coupled to said processor, said display displaying indicia, said indicia comprising information pertaining to operationally parameters of said timer, said first motor and said second motor;

an arm movably coupled to and extending laterally away from said outer wall of said housing, a second portion of said arm being slidably coupled to and extending laterally away from a first portion of said arm, a third portion of said arm being slidably coupled to and extending laterally away from the second portion of said arm wherein said arm has a telescopically adjustable length, said arm being one of a pair of arms;

a first one of said pair of arms being positioned on a first lateral side of said outer wall of said housing wherein said first arm is operationally coupled to a first motor of said pair of motors wherein said first motor alternatively raises and lowers said first arm;

a second one of said pair of arms being positioned on a second lateral side of said outer wall of said housing wherein said second arm is operationally coupled to a second motor of said pair of motors wherein said second motor alternatively raises and lowers said second arm;

a rod coupled to a first end of said third portion of said arm proximate a second end of said rod wherein said rod extends forwardly away from said arm such that said rod forms a right angle with respect to said arm wherein said rod moves in tandem with said arm, a second portion of said rod being slidably coupled to a first portion of said rod wherein said rod has a telescopically adjustable length, said rod being one of a pair of rods;

a first one of said rods being coupled to said first arm;

a second one of said rods being coupled to said second arm;

a tongue movably coupled to a top side of said rod proximate a center of one of said rods, said tongue being coextensive with said one of said rods wherein a second end of said tongue is elevated above said one of said rods proximate an end of said one of said rods such that said tongue forms an acute inside angle with respect to said one of said rods, said tongue being one of a pair of tongues;

a second end of a first one of said pair of tongues being directed toward a first end of said second portion of said rod;

a second end of a second one of said pair of tongues being directed toward said second end of said first portion of said rod;

said pair of tongues being one of a pair of sets of pairs of tongues, a first set of said pair of tongues being positioned on said first rod, a second set of said pair of tongues being positioned on said second rod;

a bed coupled between said pair of rods wherein said bed extends between said pair of rods wherein said bed is configured to support the user;

a loop coextensively coupled to an outer edge of said bed, said loop being one of a pair of loops;

a first one of said pair of loops being coupled to a first lateral side of said outer edge of said bed wherein said first loop insertably receives a first one of said rods;

a second one of said pair of loops being coupled to a second lateral side of said outer edge of said bed wherein said second loop insertably receives a second one of said rods wherein said bed is retained on said rods wherein said bed moves in tandem with said rods;

a mattress positioned on a top surface of said bed wherein a bottom surface of said mattress is coextensive with said top surface of said bed wherein the user lies on a top surface of said mattress wherein the user is alternatively rolled between a first lateral side and a second lateral side of said mattress by operation of said transfer assembly, said top surface of said mattress comprising a plurality of undulating curves extending between said first and second lateral sides wherein said plurality of undulating curves are evenly distributed between a front end and a rear end of said mattress;

a power supply coupled to said housing, said power supply being electrically coupled to said processor; and a power cord electrically coupled to said power supply wherein a free end of said power cord extends away from an outer wall of said housing.

* * * * *